US010012063B2

(12) United States Patent
Storslett et al.

(10) Patent No.: US 10,012,063 B2
(45) **Date of Patent: *Jul. 3, 2018**

(54) RING ELECTRODE DEVICE AND METHOD FOR GENERATING HIGH-PRESSURE PULSES

(71) Applicant: Chevron U.S.A. Inc., San Ramon, CA (US)

(72) Inventors: Stein J. Storslett, Bakersfield, CA (US); Rick B. Spielman, Pocatello, ID (US)

(73) Assignee: CHEVRON U.S.A. INC., San Ramon, CA (US)

( * ) Notice: Subject to any disclaimer, the term of this patent is extended or adjusted under 35 U.S.C. 154(b) by 488 days.

This patent is subject to a terminal disclaimer.

(21) Appl. No.: 14/208,622

(22) Filed: Mar. 13, 2014

(65) Prior Publication Data

US 2014/0262227 A1 Sep. 18, 2014

Related U.S. Application Data

(60) Provisional application No. 61/801,304, filed on Mar. 15, 2013, provisional application No. 61/868,391, filed on Aug. 21, 2013.

(51) Int. Cl.
*E21B 43/26* (2006.01)
*E21B 28/00* (2006.01)

(52) U.S. Cl.
CPC ..... *E21B 43/26* (2013.01); *E21B 28/00* (2013.01)

(58) Field of Classification Search
CPC ..... E21B 43/26
See application file for complete search history.

(56) References Cited

U.S. PATENT DOCUMENTS

| | | | |
|---|---|---|---|
| 672,231 | A | 4/1901 | Lacomme |
| 696,647 | A | 4/1902 | Lacomme |
| 781,619 | A | 1/1905 | Rogers |
| 1,152,697 | A | 9/1915 | Bodde |

(Continued)

FOREIGN PATENT DOCUMENTS

| | | |
|---|---|---|
| WO | 2003/069110 A1 | 8/2003 |
| WO | 2006/023998 | 3/2006 |
| WO | 2010/027866 | 3/2010 |

OTHER PUBLICATIONS

Andres, U., et al.; "Liberation of Mineral Constituents by High-Voltage Pulses"; Powder Technology, 1986, vol. 48, pp. 269-277.

(Continued)

*Primary Examiner* — D. Andrews

(57) ABSTRACT

A method, system, and electrode assembly are disclosed that maximizes the lifetime of electrodes for high energy electrical discharges in water by arranging the electrodes in concentric rings or a stack of concentric rings. The radii and the thickness of the ring electrodes are optimized for electrical reliability, low jitter, and minimal erosion. In one embodiment, the electrode assembly is configured to be disposed in a subterranean dielectric medium, receive an electric current pulse having a length of time greater than 100 microseconds, and form an electric arc between the first electrode and the second electrode, thereby producing a pressure pulse axially away from the insulator.

45 Claims, 6 Drawing Sheets

(56) References Cited

U.S. PATENT DOCUMENTS 1,253,570 A 1/1918 Berry
1,315,540 A 9/1919 Curme, Jr.
1,376,180 A 4/1921 Wickersham
1,744,173 A 1/1930 Longhi
1,861,332 A 5/1932 Waitz
2,162,823 A 6/1939 Phillippi et al.
2,167,536 A 7/1939 Suits
2,403,990 A 7/1946 Mason
2,559,227 A 7/1951 Rieber
2,617,080 A 11/1952 Nims
2,660,556 A 11/1953 Butler
2,822,148 A 2/1958 Murray
2,870,376 A 1/1959 Tognola
2,871,943 A 2/1959 Bodine, Jr.
2,887,604 A 5/1959 Bodine, Jr.
2,931,947 A 4/1960 Fruengel
2,946,217 A 7/1960 Fruengel
3,007,133 A 10/1961 Padberg, Jr.
3,016,095 A 1/1962 Bodine
3,129,403 A 4/1964 Harter, Jr.
3,149,372 A 9/1964 Stinger
3,157,498 A 11/1964 Zernow et al.
3,158,207 A 11/1964 Rowley
3,160,952 A 12/1964 Conley et al.
3,163,141 A 12/1964 Wesley et al.
3,169,577 A 2/1965 Sarapuu
3,179,187 A 4/1965 Sarapuu
3,180,418 A 4/1965 MacLeod
3,181,328 A 5/1965 Zeitlin
3,181,799 A 5/1965 Wurzburg et al.
3,188,844 A 6/1965 Schwinghamer
3,200,626 A 8/1965 Callender
3,203,212 A 8/1965 Simicich
3,207,447 A 9/1965 Whitham
3,208,674 A 9/1965 Bailey
3,220,873 A 11/1965 Wesley
3,222,902 A 12/1965 Brejcha et al.
3,225,252 A 12/1965 Schrom et al.
3,225,578 A 12/1965 Krieger
3,228,221 A 1/1966 Zernow et al.
3,232,085 A 2/1966 Inoue
3,232,086 A 2/1966 Inoue
3,234,429 A 2/1966 Schrom
3,245,032 A 4/1966 Knott et al.
3,248,917 A 5/1966 Herring, Jr.
3,251,027 A 5/1966 Huckabay et al.
3,253,442 A 5/1966 Grove, Jr. et al.
3,267,710 A 8/1966 Inoue
3,267,780 A 8/1966 Roth
3,268,028 A 8/1966 Miller
3,273,365 A 9/1966 Felts
3,282,294 A 11/1966 Corniello
3,286,226 A 11/1966 Kearsley et al.
3,304,533 A 2/1967 Huckabay et al.
3,332,510 A 7/1967 Clark
3,338,080 A 8/1967 Golden
3,352,503 A 11/1967 Maroudas
3,354,344 A 11/1967 Schrom
3,356,178 A 12/1967 Nash, Jr.
3,358,487 A 12/1967 Brejcha et al.
3,364,708 A 1/1968 Padberg, Jr.
3,366,564 A 1/1968 Allen
3,368,194 A 2/1968 Cholet et al.
3,369,217 A 2/1968 Luehrmann et al.
3,371,404 A 3/1968 Lemelson
3,376,633 A 4/1968 Wesley
3,386,507 A 6/1968 Lumpkin
3,394,569 A 7/1968 Smith
3,401,473 A 9/1968 Schrom et al.
3,402,120 A 9/1968 Allen et al.
3,403,375 A 9/1968 Wright, Jr. et al.
3,408,432 A 10/1968 Tumm et al.
3,416,128 A 12/1968 Allen
3,418,835 A 12/1968 Erlandson
3,423,979 A 1/1969 Smith et al.
3,428,940 A 2/1969 Huckabay
3,452,565 A 7/1969 Cadwell
3,458,858 A 7/1969 Wright, Jr.
3,486,062 A 12/1969 Schrom
3,491,010 A 1/1970 Ishibashi
3,500,942 A 3/1970 Smith, Jr.
3,512,384 A 5/1970 Inoue
3,522,167 A 7/1970 Allen
3,537,542 A 11/1970 Dubois et al.
3,555,866 A 1/1971 Roth
3,566,645 A 3/1971 Lemelson
3,566,647 A 3/1971 Inoue
3,572,072 A 3/1971 Hundley et al.
3,575,631 A 4/1971 Pratt
3,583,766 A 6/1971 Padberg, Jr.
3,588,580 A 6/1971 Vining
3,593,551 A 7/1971 Roth et al.
3,594,115 A 7/1971 Wesley et al.
3,603,127 A 9/1971 Seiffert et al.
3,613,823 A 10/1971 Burrage
3,679,007 A 7/1972 O'Hare
3,688,535 A 9/1972 Keinanen et al.
3,700,169 A 10/1972 Naydan et al.
3,708,022 A 1/1973 Woodruff
3,715,082 A 2/1973 Carley-Macauly et al.
3,725,226 A 4/1973 Stoner
3,728,671 A 4/1973 Poston, Jr.
3,742,746 A 7/1973 Erlandson
3,748,034 A 7/1973 Luebbe
3,750,441 A 8/1973 Schneider et al.
3,786,662 A 1/1974 Roth
3,796,463 A 3/1974 Naydan et al.
3,797,294 A 3/1974 Roth
3,822,747 A 7/1974 Maguire, Jr.
3,840,078 A 10/1974 Allgood et al.
3,840,270 A 10/1974 Allgood, Jr.
3,842,907 A 10/1974 Baker et al.
3,874,450 A 4/1975 Kern
3,881,559 A 5/1975 Allgood et al.
3,923,099 A 12/1975 Brandon
3,931,856 A 1/1976 Barnes
3,946,809 A 3/1976 Hagedorn
3,965,982 A 6/1976 Medlin
3,990,512 A 11/1976 Kuris
4,039,042 A 8/1977 Edwards et al.
4,066,544 A 1/1978 Stark
4,074,758 A 2/1978 Scott
4,076,980 A 2/1978 Arnold et al.
4,084,637 A 4/1978 Todd
4,084,638 A 4/1978 Whiting
4,084,639 A 4/1978 Todd
4,135,579 A 1/1979 Rowland
4,164,978 A 8/1979 Scott
4,169,029 A 9/1979 Smirnov et al.
4,169,503 A 10/1979 Scott
4,196,329 A 4/1980 Debettencourt
4,313,573 A 2/1982 Goldberger et al.
4,343,356 A 8/1982 Riggs et al.
4,345,650 A * 8/1982 Wesley ..... E21B 36/04 166/177.2
4,401,162 A 8/1983 Osborne
4,458,153 A 7/1984 Wesley
4,471,838 A 9/1984 Bodine
4,479,680 A 10/1984 Wesley et al.
4,487,264 A 12/1984 Hyne et al.
4,525,612 A 6/1985 Kawashima
4,527,085 A 7/1985 Bohan, Jr. et al.
4,540,127 A 9/1985 Andres
4,550,779 A 11/1985 Zakiewicz
4,567,945 A 2/1986 Segalman
4,630,607 A 12/1986 Duinker et al.
4,640,353 A 2/1987 Schuh
4,649,997 A 3/1987 Bousaid
4,651,311 A 3/1987 Owen et al.
4,651,825 A 3/1987 Wilson
4,653,697 A 3/1987 Codina
4,667,738 A * 5/1987 Codina ..... E21B 43/2401 166/248
4,715,376 A 12/1987 Nowacki et al.

(56) References Cited

U.S. PATENT DOCUMENTS

| | | | | |
|---|---|---|---|---|
| 4,734,894 | A | 3/1988 | Cannelli et al. | |
| 4,741,405 | A | 5/1988 | Moeny et al. | |
| 4,917,785 | A | 4/1990 | Juvan | |
| 4,957,606 | A | 9/1990 | Juvan | |
| 4,990,732 | A | 2/1991 | Dudko et al. | |
| 5,004,050 | A | 4/1991 | Sizonenko et al. | |
| 5,026,484 | A | 6/1991 | Juvan | |
| 5,049,822 | A | 9/1991 | Zoltan | |
| 5,105,154 | A | 4/1992 | Givens | |
| 5,106,164 | A | 4/1992 | Kitzinger et al. | |
| 5,151,630 | A | 9/1992 | Boy et al. | |
| 5,228,011 | A | 7/1993 | Owen | |
| 5,282,508 | A | 2/1994 | Ellingsen et al. | |
| 5,287,382 | A | 2/1994 | Destannes et al. | |
| 5,301,169 | A | 4/1994 | Baria et al. | |
| 5,368,724 | A | 11/1994 | Ayers et al. | |
| 5,386,877 | A | 2/1995 | Codina | |
| 5,398,217 | A | 3/1995 | Cannelli | |
| 5,425,570 | A | 6/1995 | Wilkinson | |
| 5,430,346 | A | 7/1995 | Johnson | |
| 5,432,756 | A | 7/1995 | Bryden | |
| 5,464,513 | A | 11/1995 | Goriachev et al. | |
| 5,482,357 | A | 1/1996 | Wint et al. | |
| 5,573,307 | A | 11/1996 | Wilkinson | |
| 5,731,655 | A | 3/1998 | Corrado | |
| 5,773,750 | A | 6/1998 | Jae et al. | |
| 5,896,938 | A | 4/1999 | Moeny et al. | |
| 5,948,171 | A * | 9/1999 | Grothaus | B08B 3/12 134/1 |
| 6,018,502 | A | 1/2000 | Fry, Jr. | |
| 6,080,029 | A | 6/2000 | Johnson et al. | |
| 6,094,809 | A | 8/2000 | Grassi, Jr. | |
| 6,145,934 | A | 11/2000 | Arai et al. | |
| 6,164,388 | A | 12/2000 | Martunovich et al. | |
| 6,215,734 | B1 | 4/2001 | Moeny et al. | |
| 6,227,293 | B1 | 5/2001 | Huffman et al. | |
| 6,269,883 | B1 | 8/2001 | Gissler et al. | |
| 6,414,419 | B1 | 7/2002 | Kim | |
| 6,427,774 | B2 | 8/2002 | Thomas et al. | |
| 6,457,778 | B1 | 10/2002 | Chung et al. | |
| 6,591,649 | B1 | 7/2003 | Gafri et al. | |
| 6,705,425 | B2 | 3/2004 | West | |
| 6,761,416 | B2 | 7/2004 | Moeny et al. | |
| 6,978,672 | B1 | 12/2005 | Chen | |
| 7,037,040 | B2 | 5/2006 | Phillips | |
| 7,233,150 | B2 | 6/2007 | Chen | |
| 7,270,195 | B2 | 9/2007 | MacGregor et al. | |
| 7,384,009 | B2 | 6/2008 | Moeny | |
| 7,398,823 | B2 | 7/2008 | Montgomery | |
| 7,416,032 | B2 | 8/2008 | Moeny et al. | |
| 7,493,787 | B2 | 2/2009 | Golovashchenko et al. | |
| 7,527,108 | B2 | 5/2009 | Moeny | |
| 7,530,406 | B2 | 5/2009 | Moeny et al. | |
| 7,674,723 | B2 | 3/2010 | Porshnev et al. | |
| 7,677,673 | B2 | 3/2010 | Tranquilla et al. | |
| 7,721,428 | B2 | 5/2010 | Stoving et al. | |
| 8,172,006 | B2 | 5/2012 | Moeny | |
| 8,186,454 | B2 | 5/2012 | Moeny | |
| 8,220,537 | B2 | 7/2012 | Leon | |
| 8,227,779 | B2 | 7/2012 | Neff | |
| 8,253,417 | B2 | 8/2012 | Pislak | |
| 8,596,349 | B2 | 12/2013 | Leon et al. | |
| 8,614,580 | B2 | 12/2013 | Combee | |
| 9,394,776 | B2 | 7/2016 | Leon et al. | |
| 2003/0205376 | A1 | 11/2003 | Ayoub | |
| 2005/0150688 | A1 | 7/2005 | MacGregor | |
| 2005/0167099 | A1 | 8/2005 | Phillips | |
| 2005/0183858 | A1 | 8/2005 | Ayoub | |
| 2005/0279161 | A1 | 12/2005 | Chen | |
| 2005/0279497 | A1 | 12/2005 | Chen | |
| 2005/0280419 | A1 | 12/2005 | Chen | |
| 2006/0038437 | A1 | 2/2006 | Moeny | |
| 2006/0151166 | A1 | 7/2006 | Montgomery | |
| 2006/0208738 | A1 | 9/2006 | Moore | |
| 2007/0152494 | A1 | 7/2007 | Moeny | |
| 2007/0175502 | A1 | 8/2007 | Sliwa et al. | |
| 2008/0041462 | A1 | 2/2008 | Janway et al. | |
| 2008/0277508 | A1 | 11/2008 | Moeny | |
| 2009/0050371 | A1 | 2/2009 | Moeny | |
| 2009/0294121 | A1 | 12/2009 | Leon | |
| 2011/0011592 | A1 | 1/2011 | Leon | |
| 2011/0308789 | A1 | 12/2011 | Zhang | |
| 2012/0146650 | A1 | 6/2012 | Combee | |
| 2012/0194196 | A1 | 8/2012 | Combee | |
| 2012/0256634 | A1 | 10/2012 | Morys | |
| 2013/0255936 | A1 * | 10/2013 | Geilikman | E21B 43/26 166/248 |
| 2013/0312957 | A1 | 11/2013 | Grimes | |
| 2014/0008072 | A1 | 1/2014 | Rey-Bethbeder | |
| 2014/0008073 | A1 * | 1/2014 | Rey-Bethbeder | E21B 36/04 166/308.1 |
| 2014/0060814 | A1 * | 3/2014 | Leon | E21B 43/26 166/177.5 |
| 2014/0262226 | A1 | 9/2014 | Storslett et al. | |

OTHER PUBLICATIONS

Andres, U.; "Liberation Study of Apatite—Nepheline Ore Comminuted by Penetrating Electrical Discharges"; International Journal of Mineral Processing, 1977, vol. 4, pp. 33-38.

Andres, U.; "Parameters of Disintegration of Rock by Electrical Pulses"; 1989, Powder Technology, vol. 58, pp. 265-269.

Hasebe, Tadashi, et al.; "Focusing of Shock Wave by Underwater Discharge on Nonlinear Reflection and Focusing Effect"; English Abstract, J. Soc. Mat. Sci., Japan, vol. 45, No. 10, Oct. 1996.

Hawrylewicz, B.M., et al.; "Experiment with Electric Discharge in Rock Splitting"; Sym. on Rock Mechanics, 1986, Chapter 62, pp. 429-435.

Mao, Ronghai, et al.; "Experiments on Pulse Power Fracturing"; SPE 153805, Mar. 2012, pp. 1-16.

Maurer, William C.; "Spark Drilling"; 1969, Soc. Mining Eng. Proc. of the 11$^{th}$ Sym. on Rock Mechanics, Chapter 33, pp. 687-703.

McClung, I. Buford; "The Feasibility of Developing a Borehole Spanker for Geothermal Wells"; Jan. 1977, EG&G Energy Measurements, Inc., 1997, LOA 217, Title Page, Disclaimer, Acknowledgements, Table of Contents p. v, pp. 1-17.

Pierce, K.G., et al.; "Advanced Drilling Systems Study"; 1995, Sandia National Laboratories Report, SAND95-0331, Distribution Category UC-258, Title Page, Acknowledgements, Table of Contents, pp. I-1 through III-44 (Part 1).

Pierce, K.G., et al.; "Advanced Drilling Systems Study"; 1995, Sandia National Laboratories Report, SAND95-0331, Distribution Category UC-258, pp. III-45 through V-39 (Part 2).

Pierce, K.G., et al.; "Advanced Drilling Systems Study"; 1995, Sandia National Laboratories Report, SAND95-0331, Distribution Category UC-258, pp. V-40 through IX-26, Distribution—5 pages (Part 3).

International Search Report, dated May 16, 2011, during the prosecution of International Application No. PCT/US2008/084662.

Written Opinion of the International Searching Authority, dated May 16, 2011, during the prosecution of International Application No. PCT/US2008/084662.

Cho, S.H., et al; "Dynamic Fragmentation of Rock by High-Voltage Pulses"; ARMA/USRMS 06-1118, 41$^{st}$ U.S. Symposium on Rock Mechanics (USRMS), Jun. 2006, 9 pages.

Cho, Sang Ho., et al.; "Influence of the Applied Pressure Waveform on the Dynamic Fracture Processes in Rock"; 2004, International Journal of Rock Mechanics & Mining Sciences, vol. 41, pp. 771-784.

Dubovenko, K.V., et al.; "Underwater Electrical Discharge Characteristics at High Values of Initial Pressure and Temperature"; Abstract, 25$^{th}$ IEEE International Conference on Plasma Science, 1998.

Hammon, Jud, et al.; "Electric Pulse Rock Sample Disaggregator"; IEEE International PulsedPower Conference, 2001, 4 pages.

Loeffler, M., et al.; "Electrical Wire Explosions as a Basis for Alternative Blasting Techniques"; International Conference on Pulsed Power Applications, Mar. 2001, pp. E.16/1-E.16/7.

(56) References Cited

OTHER PUBLICATIONS

Madhavan, S., et al.; "Modeling of Shock-Wave Generation in Water by Electrical Discharges"; IEEE Transactions on Plasma Science, vol. 28, No. 5, Oct. 2000, pp. 1552-1557.
Nelson, Lloyd S., et al ; "Aluminum-Enhanced Underwater Electrical Discharges for Steam Explosion Triggering"; Jul. 1999, Sandia National Laboratories Report—SAND99-0796, pp. iii-45.
Sarkar, P., et al.; "Operation of a Capacitor Bank for Plasma Metal Forming"; 2000, Indian Academy of Sciences, vol. 55, Nos. 5 & 6, pp. 941-945.
Touryan, K.J., et al.; "Electrohydraulic Rock Fracturing by Pulsed Power"; 7$^{th}$ IEEE Conference on Pulsed Power 1, (1989), pp. 69-72.
Wakeland, P., et al.; "Hydrodynamic Loading of Structural Components Due to Electrical Discharge in Fluids"; 14$^{th}$ IEEE Conference on Pulsed Power 2, Jun. 2003, pp. 925-928.
Weise, Th. H.G.G., et al.; "Experimental Investigations on Rock Fracturing by Replacing Explosives with Electronically Generated Pressure Pulses"; 1993, 9$^{th}$ IEEE Conference on Pulsed Power 1, pp. 19-22.

* cited by examiner

RING ELECTRODE DEVICE AND METHOD FOR GENERATING HIGH-PRESSURE PULSES

PRIORITY CLAIMS

This application claims benefit under 35 USC 119 of U.S. Provisional Patent Application Nos. 61/801,304 with a filing date of Mar. 15, 2013 and 61/868,391 with a filing date of Aug. 21, 2013, the disclosures are incorporated herein by reference in their entirety.

TECHNICAL FIELD

The present invention relates to a ring electrode device and method for generating an electric discharge that produces a high-pressure pulse, typically of relatively long duration, in a dielectric fluid medium.

BACKGROUND

Fracturing of subterranean geological structures can be useful for assisting in the development of hydrocarbon resources from subterranean reservoirs. In certain types of formations, fracturing of a region surrounding a well or borehole can allow for improved flow of reservoir fluids to the well (e.g., oil, water, gas). A conventional method for causing such fracturing in the geologic structure involves generating hydraulic pressure, which may be a static or quasi-static pressure generated in a fluid in the borehole. Another method includes generation of a shock in conjunction with a hydraulic wave by creating an electrical discharge across a spark gap. For example, pairs of opposing electrodes, such as axial, rod, or pin electrodes, have been used to generate electrical discharges. In such electrode designs, the electrodes (e.g., with diameters ranging from 1 millimeter to approximately 1 centimeter) are typically placed apart (e.g., between one half to several centimeters) depending on the application and the voltage. These electrode configurations are typically for low-energy applications.

In higher-energy applications and with the use of conventional electrode configurations, electrode erosion may occur at the tip of the electrode and increase the spacing between the electrodes. Erosion of metal from the electrodes is roughly proportional to the total charge passing through the electrodes for a given electrode material and geometry. This erosion is usually expressed in terms of mass per charge (e.g., milligrams per coulomb, mg/C). Electrode erosion can also be expressed as eroded axial distance of the electrode per charge (e.g., millimeters per coulomb, mm/C). Thus, mass per charge (e.g., mg/C) is converted to eroded axial distance of the electrode per charge (e.g., mm/C) by expressing the eroded mass in terms of the mass of the electrode (i.e., $\rho \times \text{area} \times \text{length}$, where $\rho$ is the density of the electrode material). The table below is an example of measured erosion rates in water for various materials using a 0.32-cm-radius pin (or rod) electrode.

| Material | mg/C | mm/kC |
|---|---|---|
| brass | 5.5 | 20.7 |
| 4340 steel | 2.75 | 11.0 |
| 316 steel | 2.5 | 9.8 |
| Hastalloy | 3.5 | 13.4 |
| tantalum | 4.5 | 8.5 |

-continued

| Material | mg/C | mm/kC |
|---|---|---|
| Mallory 2000 | 2.5 | 4.4 |
| tungsten | 1.5 | 2.5 |
| Elkonite 50W-3 | 1 | 1.7 |

While not shown in the above table, the measured electrode erosion from the negative electrode was in general higher than the positive electrode by approximately 15% to 25%. As the electrode spacing increases, it becomes more difficult to create a breakdown in the medium (e.g., water) between the electrodes and the electrodes are typically adjusted or replaced to reduce the gap.

For a given electrical pulser's specifications (total delivered charge), the eroded electrode length per shot can be determined. Further, by defining the maximum allowed electrode erosion as the maximum permitted increase in the electrode gap, the lifetime of the electrode system between refurbishment can be identified. This results in an erosion formula in which the variables for a given pulser are the electrode material and the electrode radius. Realistically, the maximum electrode radius is limited by both the required geometric, electric-field enhancement (that drops with an increase in the electrode radius) and the proximity of the pin or rod electrode to the grounded wall of the chamber that encloses the arc. The low levels of field enhancement on the high-voltage, large-diameter electrode (and, simultaneously, the ground electrode) cause a significant increase in the delay time between the application of high voltage to the electrodes and the start of current flow in the arc. At the same time, there is a substantial increase in the jitter at the start of current flow.

Furthermore, for long-pulse, high-energy electrical pulsers, the operational radius can be up to approximately one (1) centimeter. With such a radius size, axial electrodes can experience additional issues. For example, the extremely long time duration of the voltage and current pulses permits the development of many pre-arc "streamers" on the electrodes. In an electrode configuration having low electric-field enhancement, these streamers form with nearly equal probability between the high-voltage and ground electrodes and between the high-voltage electrode and any other ground in the system (e.g., the wall of the generator). This physical limit in electrode radius effectively limits the available mass to be eroded with pin-electrode designs and limits the maximum current rise time of a pin electrode design.

Furthermore, the electrode gap can become a major hindrance at very high (e.g., megajoule, MJ) pulser energies. There are applications require electrical pulsers that store electrical energy up to 1 MJ and deliver a large amount of charge to the load. Such applications may also require many hundreds or thousands of shots between refurbishment. Even with excellent electrode materials, the use of simple pin or rod electrodes may not be feasible due to the rapid increase in electrode gap due to electrode erosion. Additionally, the adjustability of the electrodes leads to a primary failure mode and therefore, MJ-class electrode assemblies typically do not provide adjustment capability in order to maximize reliability.

While conventional electrode configurations have been used successfully to form fractures, there is a continued need for an improved method and apparatus for generating high-pressure pulses in a subterranean medium, thereby causing fracturing to occur.

DETAILED DESCRIPTION

Embodiments of the invention relate generally to the field of low-erosion, long-lifetime electrodes used in high energy electrical discharges in dielectric fluid media (e.g., water) to generate powerful shocks and very high pressure pulses. In one embodiment, concentric ring electrode configurations that provide extended electrode lifetime for use in very high-energy discharge systems are disclosed. The electrodes can deliver as much as a megajoule (MJ) of energy per pulse to the load and pass up to 80 C of charge. Such electrodes are physically robust and have extended lifetimes for high energy and high-coulomb pulsers (e.g., the electrodes can handle an excess of 15,000 shots with greater than 20 C per shot in embodiments).

As will be described, embodiments of the invention consist of an inner-ring, high-voltage (HV) electrode that is attached to a conducting stalk that delivers the electrical energy to the system. This inner-ring HV electrode is placed above an insulator constructed of materials including, but not limited to, high-density polyethylene (HDPE). Radially outward from the inner-ring HV electrode is an outer-ring ground electrode at ground potential. The heights of the inner-ring HV electrode and the outer-ring electrode are substantially the same (e.g., approximately 6 mm to 10 mm). In one embodiment, the radial gap is greater than or equal to about 2 cm. In one embodiment, the radial gap is greater than or equal to about 3 cm. In one embodiment, the electrode can be driven by a pulser whose stored energy reaches 1 MJ. Such a load electrode assembly is capable of generating pressures in excess of 1 kbar in very large fluid volumes, or much higher pressures in smaller volumes.

Embodiments of the invention can be utilized in a wide range of dielectric fluid media. Examples of dielectric fluid media include water, saline water (brine), oil, drilling mud, and combinations thereof. Additionally, the dielectric fluid media can include dissolved gases such as ammonia, sulfur dioxide, or carbon dioxide. The conductivity of these dielectrics can be relatively high for some situations. In one embodiment, saline water is used as a dielectric fluid. For brevity, the term "water" is occasionally used herein in place of dielectric fluid media.

Figure 1:
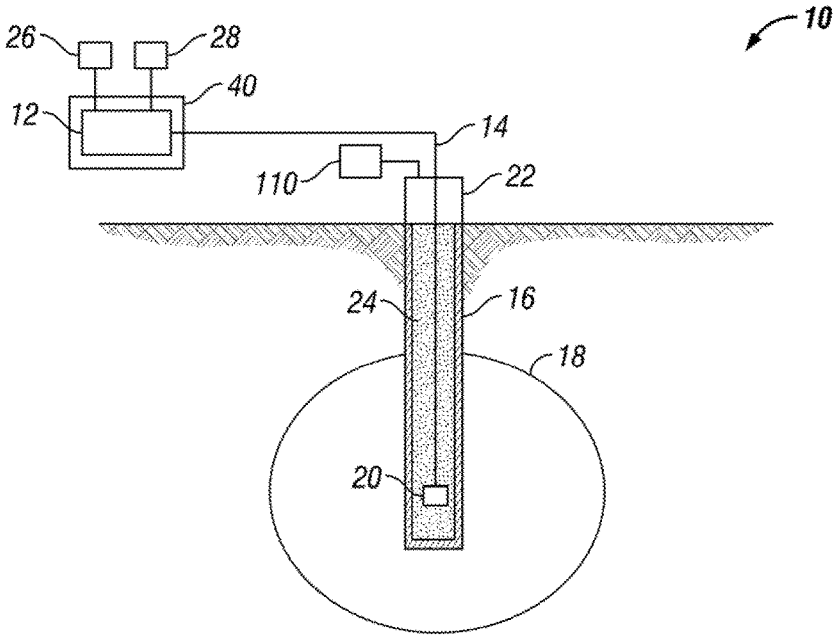
FIG. 1 is a schematic view illustrating an apparatus for generating high-pressure pulses in a subterranean dielectric medium.

Referring to FIG. 1, there is shown an apparatus 10 for generating high-pressure pulses in a subterranean dielectric fluid medium according to one embodiment. The apparatus 10 includes a pulser 12 that is configured to deliver a high voltage current through an electrical cable 14, which can be disposed within a wellbore 16 that extends to a subterraneous hydrocarbon reservoir 18. The cable 14 electrically connects the pulser 12 to an electrode assembly 20, so that the pulser 12 can power the electrode assembly 20 and generate a pulse in the wellbore 16.

The wellbore 16 can have portions that extend vertically, horizontally, and/or at various angles. Conventional well equipment 22 located at the top of the wellbore 16 can control the flow of fluids in and out of the wellbore 16 and can be configured to control the pressure within the wellbore 16. The wellbore 16 can be at least partially filled with the medium, which is typically a fluid 24 such as water, and the equipment 22 can pressurize the fluid as appropriate.

Figure 2:
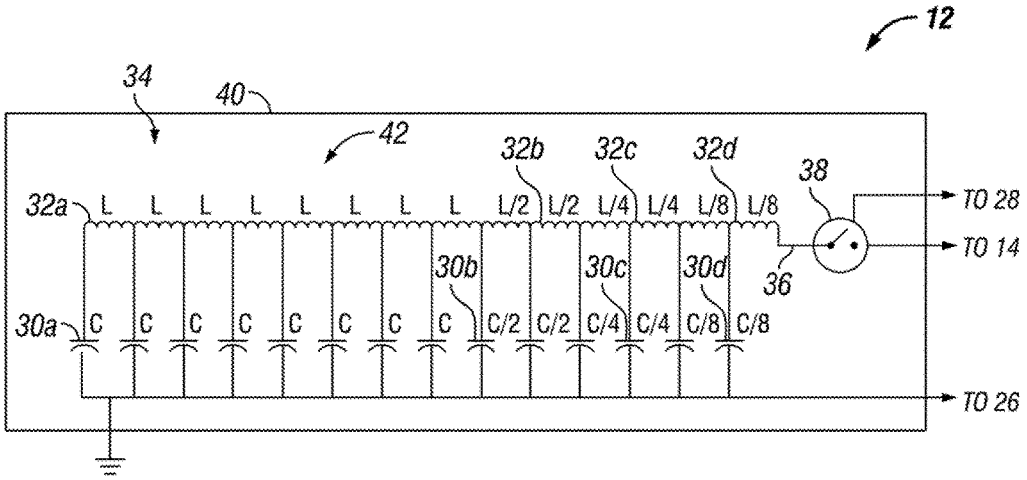
FIG. 2 is a schematic view illustrating the pulser of the apparatus of FIG. 1.
Figure 3:
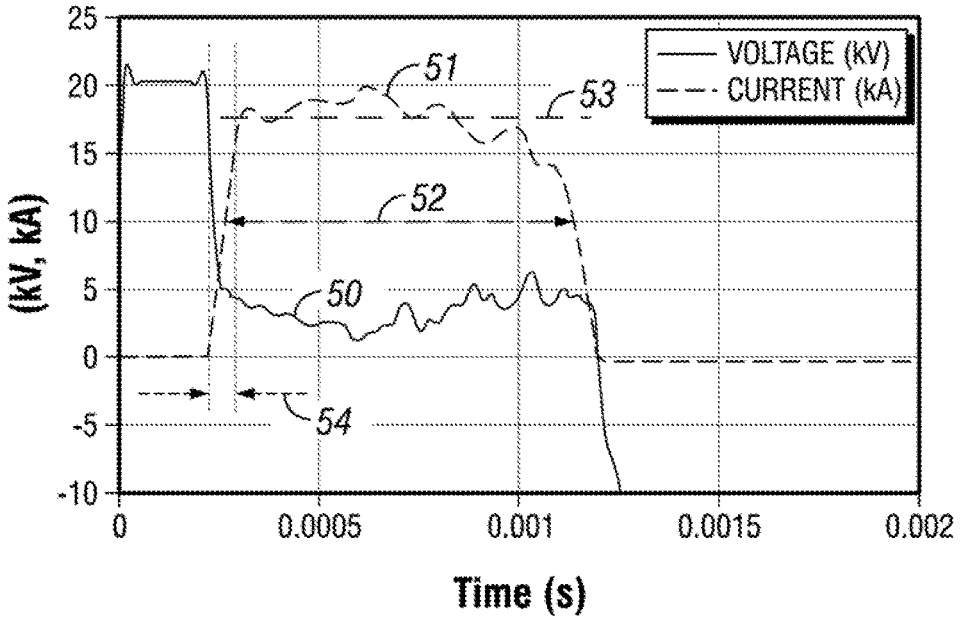
FIG. 3 is a graphic illustration of the voltage and current applied by the pulser to the electrode assembly and flowing through an arc formed in water as a function of time during operation of an apparatus according to the present disclosure.

The pulser 12 is connected to a power source 26, e.g., a device configured to provide electrical power, typically DC. A controller 28 is also connected to the pulser 12 and configured to control the operation of the pulser 12. The pulser 12 can include an electrical circuit that is configured to generate a shaped or tailored electric pulse, such as a pulse having a square (or nearly square) voltage profile, as shown in FIG. 3. For example, as shown in FIG. 2, the electrical circuit of the pulser 12 can include a plurality of capacitors 30*a*, 30*b*, 30*c*, 30*d* (collectively referred to by reference numeral 30) and inductors 32*a*, 32*b*, 32*c*, 32*d* (collectively referred to by reference numeral 32) that are arranged in parallel and series, respectively, to form a pulse-forming network ("PFN") 34. The values of the capacitors 30 and inductors 32 can vary throughout the network 34 to achieve the desired pulse characteristics. For example, each of the capacitors 30*a* in a first group (or stage) of the capacitors can have a value C, such as 100 μF, and each of the inductors 32*a* in a first group (or stage) of the inductors can have a value L, such as 80 μH. Each of the capacitors 30*b* in a second group of the capacitors can have a different value, such as ½ C, and each of the inductors 32*b* in a second group of the inductors can have a different value, such as ½ L. Each of the capacitors 30*c* in a third group of the capacitors can have a still different value, such as ¼ C, and each of the inductors 32*c* in a third group of the inductors can have a still different value, such as ¼ L. Each of the capacitors 30*d* in a fourth group of the capacitors can have a still different value, such as ⅛ C, and each inductor 32*d* in a fourth group of the inductors can have a still different value, such as ⅛ L.

A ground of the PFN 34 is connected to the power source 26, and the PFN 34 is configured to be energized by the power source 26. An output 36 of the PFN 34 is connected to the cable 14 through a switch 38, such as a solid-state isolated-gate bipolar transistor (IGBT) or another thyristor, which is connected to the controller 28 and configured to be controlled by the controller 28, so that the controller 28 can selectively operate the pulser 12 and connect the PFN 34 to the cable 14 to deliver a pulse to the electrode assembly 20. In one embodiment, the switch 38 is capable of handling a peak voltage of at least 20 kV, a maximum current of at least 20 kA, and a maximum charge of at least 100 C. The IGBT switches can be assembled by placing commercially available IGBTs in series and parallel in order to obtain the necessary voltage and current handling capabilities. In some cases, other types of switches may be used, such as gas switches of a sliding spark design.

It is also appreciated that the pulser 12 can use other energy storage devices, other than the illustrated PFN 34. For example, while the illustrated embodiment uses capacitive energy storage based on a Type B PFN configuration, it is also possible to use a PFN based on inductive energy storage and a solid-state opening switch. An inductive PFN could allow a smaller design and could also allow a lower voltage during the charging phase (e.g., a typical charging voltage of about 1 kV in the inductive PFN instead of a typical charging voltage of about 20 kV in a capacitive PFN) and only operate at high voltage for a short period (such as a few microseconds) during the opening of the switch 38.

The controller 28 can repeatedly operate the pulser 12 to deliver a series of discrete pulses. One typical repetition rate is about one pulse per second, or 1 Hz. In other cases, the pulser 12 can be operated more quickly, e.g., with a repetition rate as fast as 5 Hz or even faster, depending on the need of the particular application. If a much lower repetition rate is acceptable (such as less than 0.1 Hz), then other electrical gas switches that are unable to provide fast repetition may be usable.

The pulser 12 can be actively or passively cooled. For example, as shown in FIG. 2, the pulser 12 can be disposed in an enclosure 40 that is filled with a thermally conductive fluid 42 such as oil that cools the pulser 12. Additional equipment, such as a radiator and/or fans, can be provided for actively cooling the oil 42. In other cases, the pulser 12 can be air-cooled.

In one embodiment, the pulser 12 is configured to operate with an output voltage of between 10 kV and 30 kV, such as about 20 kV. The pulser 12 can generate a peak current between 10 kA and 20 kA, such as between 12 kA and 15 kA, depending on the impedance of the impedance of the cable 14 and the impedance of the arc generated in the dielectric fluid. The impedance of the PFN 34 can be matched to the expected load impedance at the electrode assembly 20, e.g., between 0Ω and 1Ω, such as between 0.5Ω and 0.9Ω. In another case, the peak current was kept below about 20 kA and the medium was pressurized, resulting in an impedance between 0.1Ω and 0.4Ω.

FIG. 3 shows the electrical waveform of a typical voltage pulse 50 and a typical current pulse 51 during operation of the apparatus 10. The current pulse 51 has a pulse width 52 that is determined, at least partially, by the number of elements in the PFN 34 shown in FIG. 2. The magnitude of the current 53 is determined, at least partially, by the values of the capacitors 30 and inductors 32 of the PFN 34. The rise time 54 of the current waveform 51 is determined, at least partially, by the first-group elements 30*a*, 32*a* of the PFN 34.

Figure 4:
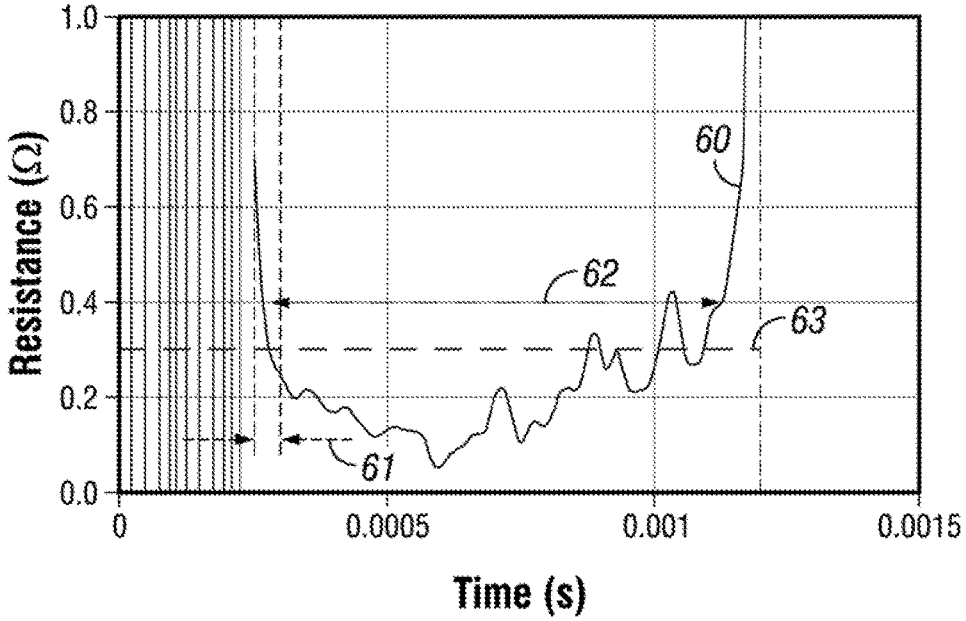
FIG. 4 is a graphic illustration of the impedance as a function of time of an electric arc formed in water during operation of an apparatus according to the present disclosure.

FIG. 4 shows the impedance 60 of one typical water arc as a function of time during operation of the apparatus 10. The rapid fall time of the impedance 62 is driven by the rapid rise of the current 54. The pulse width of the current 52 is reflected in the impedance as the pulse width of the impedance 62. The average magnitude of the impedance 63 is determined, at least partially, by the electrode geometry, the peak current 53, and the static pressure applied to the load. The average impedance 63 is nearly constant (even slightly increasing) with time.

The current can be maintained at a substantially constant level for the duration of the pulse. The pulse can be maintained to achieve a pulse length, or duration, of greater than 100 μs. For example, in embodiments the pulse duration can be maintained between 200 μs and 4 ms. Further, in other embodiments, the pulser 12 can provide a pulse duration of more than 4 ms, e.g., by adding additional capacitors 30*a* in the first group of capacitors.

Although other configurations of the PFN 34 are possible, the illustrated configuration is known as a pulsed current generator in a Type B PFN configuration, which can provide a substantially constant current pulse to electrode assembly 20 and the art formed therein through the dielectric fluid medium. The PFN-based pulser 12 allows control of the current that drives the discharge.

Although the present invention is not limited to any particular theory of operation, it is believed that the highest value capacitors 30*a* and inductors 32*a* can provide or define the basic pulse shape and the pulse duration, and the other capacitors 30*b*, 30*c*, 30*d* (and, optionally, additional capacitors) and inductors 32*b*, 32*c*, 32*d* (and, optionally, additional inductors) reduce the rise time of each pulse provided by the PFN 34. More particularly, the rise time can be determined by the rise time of the first group of capacitors 30*a* and inductors 32*a*. The PFN 34 can be designed to have a rise time of less than 100 μs, such as between 20 μs and 75 μs, typically between 25 μs and 50 μs, depending on the inductance of the cable 14, the smallest capacitance in the PFN 34, and the load at the electrode assembly 20. In general, shorter rise times can be effective, while longer times tend to have higher levels of break down jitter and longer delays between the application of voltage to the electrodes and the development of an arc.

An appropriate selection of the values of the capacitors 30 and inductors 32 in the PFN 34 can limit the peak current that the PFN 34 delivers. This is the effect of the impedance of the PFN 34, where the PFN 34 impedance ($Z_{PFN}$) is given as follows:

$$Z_{PFN} = \sqrt{\frac{L}{C}},$$

where L and C are the inductance and capacitance, respectively, of the PFN 34.

In a typical case, values of $Z_{PFN}$ are roughly in the range of 0.5Ω to 1Ω. Typically, the rise time of the current pulse from the PFN 34 is proportional to the square root of the LC of the individual elements of the PFN 34. For a load impedance greater than the impedance of the PFN 34, the rise time ($t_{rise}$) can be about ¼ the LC period, given as follows:

$$t_{rise} \cong \frac{\pi}{2}\sqrt{LC}$$

The peak current ($I_{peak}$) of an element of the PFN 34 can be proportional to the voltage on the capacitor ($V_0$), the square root of the capacitance in inversely proportional to the square root of the inductance of the element of the PFN 34 (if the impedance of the PFN 34 is larger than the load impedance), as follows:

$$I_{peak} = \frac{V_0}{Z_{PFN}} = V_0\sqrt{\frac{C}{L}}.$$

In the illustrated embodiment, the PFN 34 is modified to have smaller capacitors 30*b*, 30*c*, 30*d* and inductors 32*b*, 32*c*, 32*d* precede the main set of capacitors 30*a* and inductors 32*a* to provide shorter duration current rise time. Thus, the smaller-value capacitors 30*b*, 30*c*, 30*d* and smaller-value inductors 32*b*, 32*c*, 32*d* can be selected with values that are sized to maintain the same value of current, but will provide a smaller time to peak current as the first few elements in the PFN 34. By using this approach, the modified PFN can be made to have a rise time less than 50 μs and yet having a total duration ranging from about 200 μs to several ms. The total energy (E) stored in the PFN 34 can be the sum of the energies stored in all of the capacitors of the PFN 34 and is expressed as follows:

$$E = 0.5V^2 \sum_{i=1}^{n} C_i.$$

The energy coupled to the dielectric medium discharge can reach or even exceed 500 kJ for reasonable PFN 34 parameters and charge voltages. The number of capacitors 30 and inductors 32 in the PFN 34 can determine the pulse length of the current pulse delivered to the arc. The pulse width of the PFN 34 can be determined by the sum of the capacitances and inductances of the entire PFN 34. For example, in the illustrated embodiment, the duration of each pulse, or pulse width ($t_{pw}$), of the PFN 34 is given as follows:

$$t_{pw} = 2\left(\sum_{i=1}^{n} L_i \sum_{i=1}^{n} C_i\right)^{0.5}$$

In one example, the pulse width is between about 1 ms and 4 ms, the total capacitance of the PFN 34 is between about 1 mF and 4 mF, the peak current is about 15-18 kA, and the total inductance of the PFN 34 is between about 0.4 mH and 1.6 mH. In other cases, where less energy is required and a shorter pulse is desirable, the number of stages of first-group capacitors 30*a* and first-group inductors 32*a* can be reduced to decrease the pulse length and stored energy. One such embodiment would use only 5 capacitors 30*a* and 5 inductors 32*a* in the first group, together with the faster stages (30*b*, 30*c*, 30*d* and 32*b*, 32*c*, 32*d*) to generate a 1-ms pulse.

The total energy of the pulse can also be varied according to the fracturing needs of a particular reservoir. In some cases, the total energy of each pulse can be between 50 kJ and 500 kJ (e.g., 450 kJ). The total energy per pulse can be reduced, if needed, by reducing the number of the capacitors 30*a* in the first group of the PFN 34, or the energy per pulse can be increased by adding to the number of the capacitors 30*a* in the first group of the PFN 34.

It is appreciated that the pulser 12 can be optimized to provide a pulse length (e.g., by adjusting the number of groups of capacitors 30 and inductors 32 in the PFN 34), rise time (e.g., by adjusting the size of the smaller-value capacitors 30*b*, 30*c*, 30*d* and inductors 32*b*, 32*c*, 32*d* in the PFN 34), maximum voltage, and repetition rate depending on the specific application and manner of use. Generally, it is believed that a current greater than about 20 kA for pulses in water may result in arc impedances that are too low for efficient energy coupling. On the other hand, arc currents that are too low may be subject to uncontrolled arc quenching for longer pulses. The electrode assembly 20 is connected to the cable 14 and configured to create one or more electric arcs when the electric pulse is delivered via the cable 14.

Figure 5:
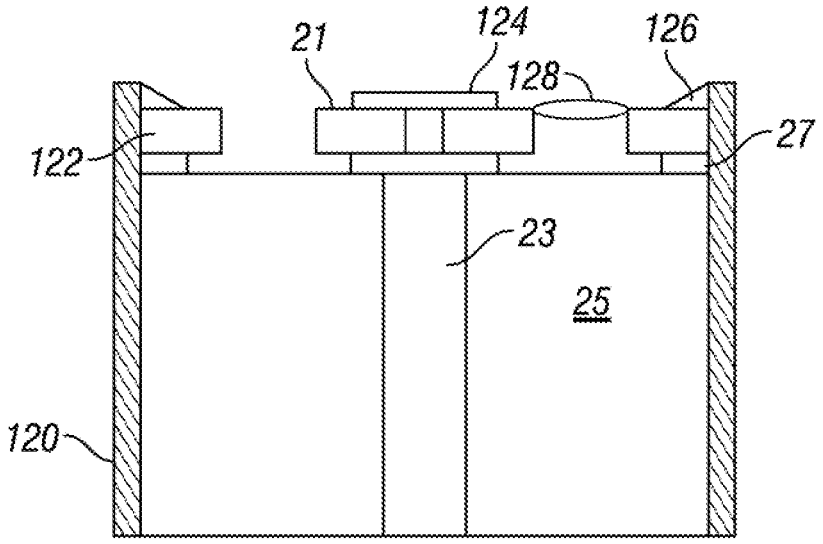
FIG. 5 is a schematic of a ring electrode device.

FIG. 5 shows a schematic of an electrode configuration using concentric ring electrodes. The ring electrode design is composed of an inner, ring-shaped high-voltage (HV) electrode 21 and an outer, ring-shaped ground electrode 122. The inner-ring HV electrode 21 is mounted to a conducting stalk 23 via an appropriate connection method, such as but not limited to a welded connection. The HV electrode 21 is insulated (e.g., with a high-density polyethylene (HDPE) or similar insulator) via insulation system 25. The outer ring electrode 122 is held inside the steel body 120 and is clamped between a steel stop ring 126 that is welded to the housing 120 and a stainless-steel spacer ring 27. The HDPE insulator 25 in the tool housing 120 is clamped against the stainless-steel spacer ring 27. The electrical energy is conducted to the inner-ring HV electrode 21 via the HV electrode stalk 23. When voltage is applied to the inner-ring HV electrode 21 an electric field is created that is radially oriented to the ring ground electrode 122. The tool assembly as shown generates radial arcs between an outer-ring ground electrode 122 and an inner-ring HV electrode 21. The pressure pulse generated by the arc moves axially upward away from the electrodes and there is also a reflection against the insulator 25 that supports the inner-ring HV electrode 21 and the high-voltage electrical connection 23. In contrast to conventional axial electrodes, this ring orientation eliminates other significant electric fields and there are no pathways for parasitic arcs. In this case, the magnitude of the electric field is determined by the gap between the inner-ring HV electrode 21 and the outer-ring ground electrode 122, and the height (vertical thickness) of the inner-ring HV electrode 21 and the outer-ring ground electrode 122 (field enhancement). Material erosion on the inner-ring HV electrode 21 and the outer-ring ground electrode 122 serves to roughen the surface of the two electrodes and enhance the local electric fields. In this radial arc configuration, the inner-ring HV electrode 21 will typically erode more slowly than the outer-ring ground electrode 122 when it is placed in a positive polarity. In particular, the outer-ring ground electrode 122 has a larger surface area than the inner-ring HV electrode 21 because of its larger radius. This larger surface area balances the higher erosion on ground electrode 122.

In embodiments, the concentric ring electrode assembly has a typical operating voltage of 20 kV and is capable of handling the energy and charge delivered by a large capacitor bank or pulse forming network that stores up to 1 MJ. The thickness or height of the inner-ring HV electrode 21 is 1 cm. The thickness or height of the outer-ring ground electrode 122 is 1 cm. The choice of height is a tradeoff between maximizing the erodible electrode mass and maintaining sufficient electric field enhancement for reliable operation with low jitter and delay. The initial outer diameter of the inner-ring HV electrode 21 is 4.5 cm. The initial, inner diameter of the outer-ring ground electrode is 8.5 cm. This gives an initial electrode gap of 2 cm. The inner-ring HV electrode 21 has an initial surface area of 13.3 cm2. The outer-ring ground electrode 122 has an initial surface area of 25.3 cm2. The ring-electrodes can have a gap of about 3 cm, and therefore, the design of the electrode assembly accepts approximately 0.5 cm of erosion from each electrode. The inner-ring HV electrode is in positive polarity and the outer-ring ground electrode is in negative polarity. Because the erosion from the negative electrode is typically 15-25% larger than a positive electrode, by placing the smaller, inner-ring HV electrode in positive polarity, the larger erosion rate is shifted to the more massive outer-ring ground electrode.

In embodiments, the electrode material is Elkonite™ 50W-3. Elkonite™ 50W-3 is composed of 10% copper and 90% tungsten. As much as 120 g of Elkonite™ from each electrode can be eroded before replacement, which translates to a lifetime of greater than 5000 shots for a typical electrical pulser storing hundreds of kJ.

The inner-ring HV electrode 21 is assembled to prevent routine shots from loosening the mechanical and electrical connections. There are huge mechanical shocks applied to the inner-ring HV electrode during each shot and the impact of hundreds or thousands of shots can play a toll on all mechanical connections. In embodiments, no mechanical adjustments are provided as such connections impart failure points. For example, typical bolted connection using the best locking washers and thread locking compounds are likely to fail due to the shots. In embodiments, locking pins are used. However, locking pins can weaken the HV electrode stalk 23 and result in a higher probability of mechanical failure. In embodiments, inner-ring HV electrode 21 is compressed between the base of the HV electrode stalk 23 and the washer 124. After compression, the washer 124 is TIG welded to the electrode stalk 23. Here, the electrode assembly has a lifetime that is governed by the erosion of the inner-ring HV electrode 21. The welded, high-compression connection also makes an excellent electrical contact between the HV electrode stalk 23 and the inner-ring HV electrode 21. In embodiments, low-resistance contacts for the electrodes are utilized because of the very high currents and the large charges carried by the electrodes. In particular, the HV electrode 21, the HV electrode stalk 23, and the HV electrode washer 124 is modular and are designed to minimize contact resistance. Replacement is a simple task that takes only a few minutes.

In embodiments, the outer-ring ground electrode 122 is sandwiched between the lip 126 that is mounted to the housing 120 and spacer ring 27. The insulator system 25 compresses the spacer ring 27 and the outer-ring ground electrode 122 against the lip 126. The outer-ring ground electrode 122 and the stainless-steel spacer ring 27 are lightly press fit into the housing 120. The outer-ring ground electrode 122 can be replaced easily during refurbishment of the tool.

In embodiments, the HV electrode assembly (21, 23, & 124) is supported by a large, robust insulator system 25. The up to MJ energies used with the electrode assembly utilize a physically large, mechanically strong insulator. The typical outer diameter of the insulator 25 is approximately 12 cm. The length of the insulator is determined by the strength requirements and is typically equal to or greater than the diameter. Slightly ductile insulators such as Teflon™, high-density polyethylene (HDPE), and nylon tend to be more reliable than more brittle insulators (polycarbonate—Lexan™, acrylic—Plexiglas™, ceramic such as alumina, etc.). In embodiments, HDPE or ultra-high-molecular-weight polyethylene (UHMW PE) are used as the insulating material. The diameter of the HV electrode stalk 23 can be maximized to better distribute the mechanical forces from the water arcs that are delivered to the inner-ring HV electrode 21 over the area of the insulator 25. The inner-ring HV electrode 21 and the HV electrode stalk 23 are mounted to the insulator 25 in such a manner to avoid mechanical stress build up.

Figure 6:
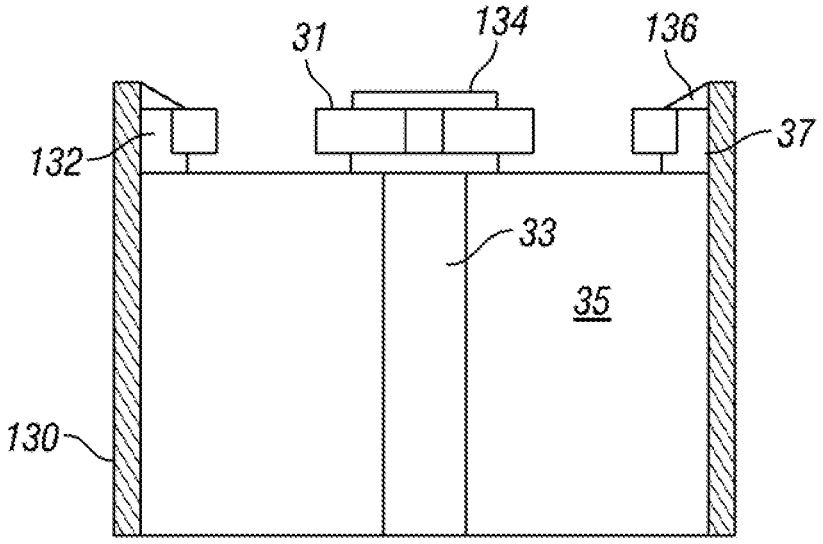
FIG. 6 is a schematic of a ring electrode device having an outer ring ground electrode pressed into a steel support ring.

FIG. 6 shows a schematic of an electrode configuration using concentric ring electrodes. The outer-ring ground electrode 132 is now pressed into the stainless-steel spacer ring 37. Therefore, the assembly of the outer-ring ground electrode 132 and the stainless-steel spacer ring 37 is now a single piece. The ring electrode design is composed of an inner, ring-shaped high-voltage (HV) electrode 31 and a ring-shaped ground outer electrode 132. The inner-ring HV electrode 31 is mounted to a conducting stalk 33, such as by a welded connection via washer 134. In embodiments, the inner-ring HV electrode 31 can be held by insulation system 35 such as a high-density polyethylene (HDPE) or similar insulator material. The insulator system 35 is retained in the tool housing 130 with a stop ring 136 that is welded to the housing 130. When voltage is applied to the inner-ring HV electrode 31 an electric field is created that is radially oriented to the ring ground electrode 132. The tool assembly as shown generates radial arcs between an outer-ring ground electrode 132 and an inner-ring HV electrode 31. The magnitude of the electric field is determined by the gap between the inner-ring HV electrode 31 and the outer-ring ground electrode 132, and the height (vertical thickness) of the inner-ring HV electrode 31 and the outer-ring ground electrode 132 (field enhancement).

Figure 7A:
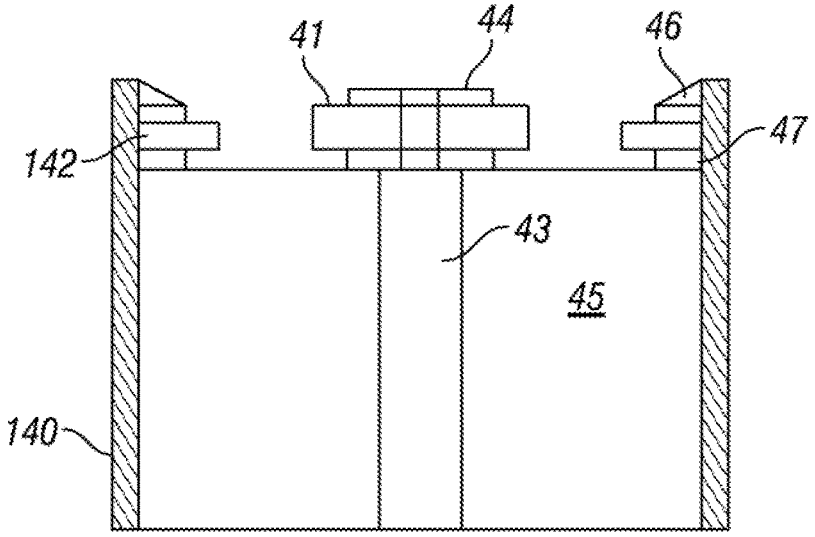
FIG. 7A is a schematic of a ring electrode device having an array of outer pin ground electrodes.
Figure 7B:
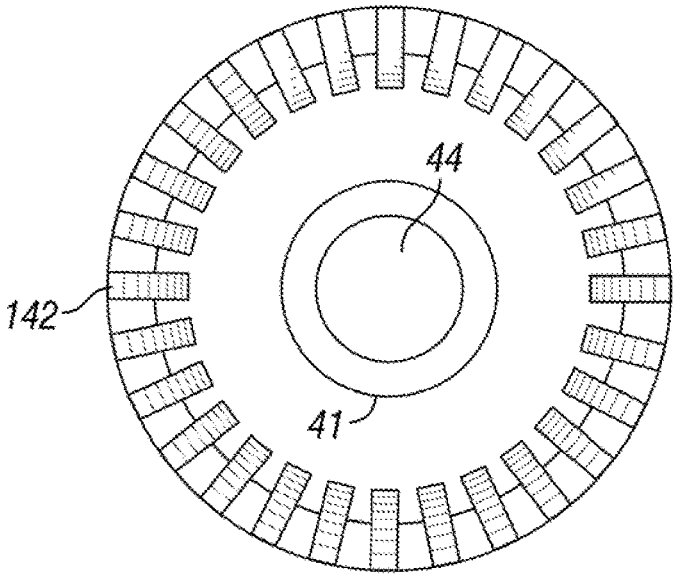
FIG. 7B is a top view of the ring electrode device shown in FIG. 7A.

FIG. 7A shows a schematic of an electrode configuration using pin and ring electrodes. In particular, FIG. 7A is a schematic of a ring electrode device having an array of outer pin ground electrodes and FIG. 7B is a top view of the ring electrode device shown in FIG. 7A. The tool assembly as shown generates radial arcs between multiple pin ground electrodes 142 and an inner-ring HV electrode 41. Multiple pin ground electrodes 142 can be mounted (e.g., hydraulically pressed into interference-fit holes) to the stainless-steel spacer ring 47. Here, the assembly of the pin ground electrodes 142 and the stainless-steel spacer ring 47 is a single piece. The resulting ground electrode has a large number of ground pin electrodes arranged circumferentially around the inner-ring HV electrode 41. The inner-ring HV electrode 41 is mounted to a conducting stalk 43, such as by a welded connection 44. The inner-ring HV electrode 41 can be held by a high-density polyethylene (HDPE) or similar insulator (insulation system 45). The insulator system 45 can be retained in the tool housing 140 with a stop ring 46 that is welded to the housing 140. When voltage is applied to the inner-ring HV electrode 41 an electric field is created that is radially oriented to the pin ground electrodes 142.

The magnitude of the electric field is determined by the gap between the inner-ring HV electrode 41 and the pin ground electrodes 142, and the height (vertical thickness) of the inner-ring HV electrode 41 and the pin ground electrodes 42 (field enhancement). In embodiments, outer pin ground electrodes 142 are approximately 1.5 cm thick. The multiple pin ground electrodes 142 reduce cost compared to a custom-machined massive outer ring and increases electric field enhancement on the pin electrode tips due their smaller diameter. In embodiments, the number of pins and the diameter of the pins are chosen to keep the total erodible mass of the pin ground electrodes 142 at least 15% greater than the mass of the inner-ring HV electrode 41. In embodiments, forty-two (142) 6.35-mm-diameter Elkonite™ pins are used as the ground electrode. In this case, the erodible mass of the Elkonite™ pin ground electrodes 142 is comparable to the mass on the inner-ring HV electrode 41. The higher field enhancement with these Elkonite™ pins allows a working gap as large as 3.5 cm.

Figure 8A:
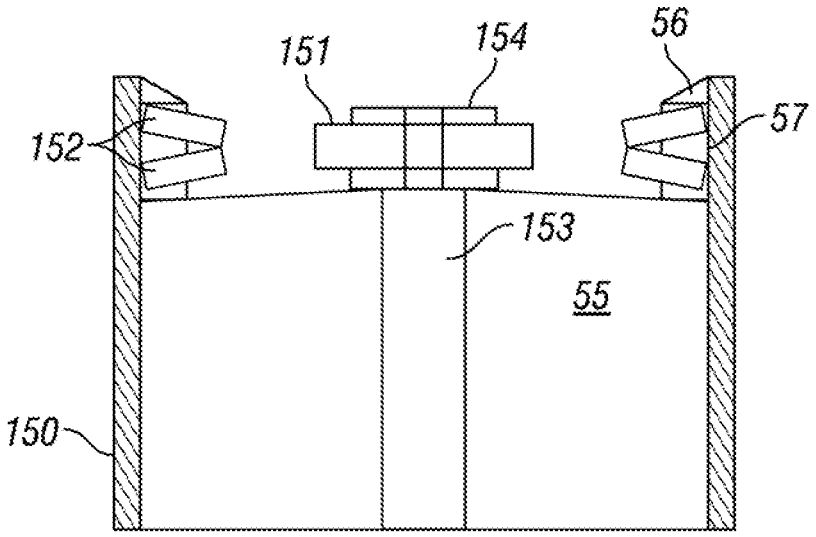
FIG. 8A is a schematic of a ring electrode device having stacked arrays of outer pin ground electrodes.
Figure 8B:
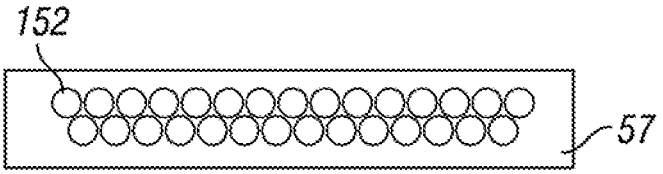
FIG. 8B is an unfolded front sectional view of the stacked arrays of outer pin ground electrodes of the ring electrode device shown in FIG. 8A.

FIG. 8A shows a schematic of an electrode configuration using stacked pin and ring electrodes. In particular, FIG. 8A is a schematic of a ring electrode device having stacked arrays of outer pin ground electrodes and FIG. 8B is an unfolded front sectional view of the stacked arrays of outer pin ground electrodes of the ring electrode device shown in FIG. 8A. The tool assembly as shown generates radial arcs between two layers of pin ground electrodes 152 and a single inner-ring HV electrode 151. Two layers of pin ground electrodes 152 can be hydraulically pressed into the stainless-steel spacer ring 57. The pins 152 are angled slightly to aim at the inner-ring HV electrode 151. The assembly of the two layers of pin ground electrodes 152 and the stainless-steel spacer ring 57 can be a single piece. The resulting ground electrode has a large number of ground pin electrodes arranged circumferentially around the inner-ring HV electrode 151. The inner-ring HV electrode 151 can be mounted to a conducting stalk 153, for example via a welded connection 54, and held by insulation system 55. Insulation system 55 can be a high-density polyethylene (HDPE) or similar insulator material. The insulator system 55 in the tool housing 150 can also compress the stainless-steel spacer ring 57, which holds pin electrodes 152, against a stop ring 56 that is welded to the housing 150.

FIG. 8B shows the slightly staggered orientation of the pins as viewed in a radially outward direction.

Figure 9:
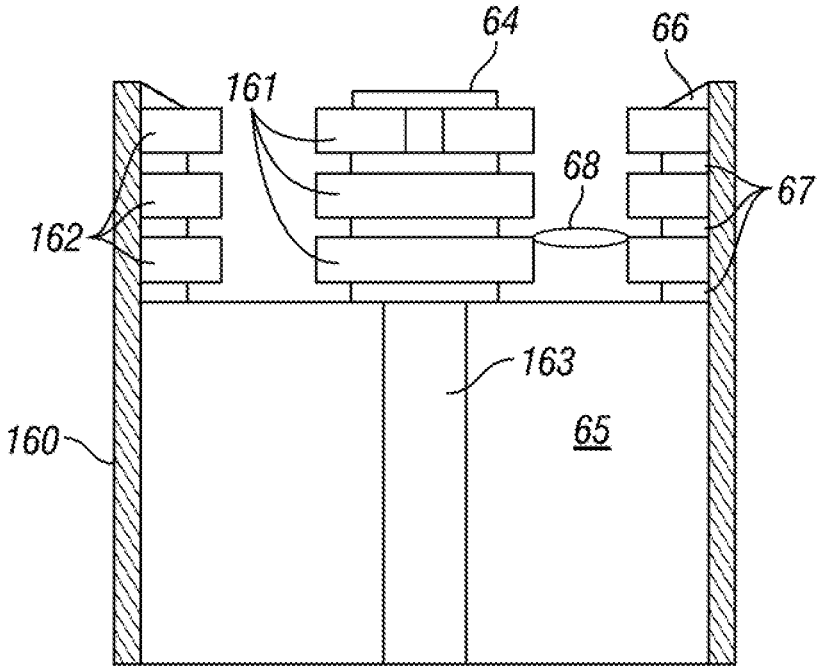
FIG. 9 is a schematic of a ring electrode device having multiple stacks of electrodes.

FIG. 9 shows a schematic of an electrode configuration using stacked inner and outer ring electrodes. The tool assembly as shown generates radial arcs 68 (like radial arc 128 of FIG. 5) between multiple, outer-ring ground electrodes 162 and multiple, inner-ring HV electrodes 161. The pressure pulse generated by the arc moves axially upward and there is a pressure reflection against insulator system 65, which supports the inner-ring HV electrodes 161 and the high-voltage electrical connection 163. The stacked ring electrode design is composed of multiple, inner-ring high-voltage (HV) electrodes 161 and multiple outer-ring ground electrodes 162 that are spaced apart by a distance approximately equal to the ring electrode height. The inner-ring HV electrodes 161 are mounted to a conducting stalk 163, such as via a welded connection 64, and the HV electrode stalk 163 can be held by insulation system 65. Insulation system 65 can be a high-density polyethylene (HDPE) or similar insulator material. The outer ring electrodes 162 can be held inside the steel body 160 and clamped between a steel stop ring 66 that can be welded to the housing 160 and multiple stainless-steel spacer rings 67. The insulator system 65 in the tool housing 160 can be clamped against the bottom-most stainless-steel spacer ring 67. In a stacked configuration, multiple inner-ring HV electrodes 161 and multiple outer-ring ground electrodes 162 are stacked on top of one another with a spacing approximately equal to their thickness. In a multiple-ring electrode stack, pin electrodes can be used rather than ring electrodes 162 for the ground electrode. This keeps the electric field enhancement very high and keeps the arcs at their desired locations on the various inner-ring HV electrodes.

In embodiments, an 8.5-cm-ID, outer-ring ground electrode (122, 132, 142, 152, 162) and a 4.5-cm-OD HV inner-ring HV electrode (21, 31, 41, 151, 161) are utilized. In this case, the outer electrode (122, 132, 142, 152, 162) has an inner surface area that is nearly two times larger than the outer surface area of the inner-ring HV electrode (21, 31, 41, 151, 161). In some embodiments, the diameter of both electrodes is increased. For example, the outer-ring ground electrode (122, 132, 142, 152, 162) could have an ID in the range of 8.5 cm to 16 cm and the inner-ring HV electrode (21, 31, 41, 151, 161) could have an OD in the range of 4.5 cm to 12 cm. In embodiments, the electrode gap is initially set to 2 cm. In embodiments, the electrode gap is initially set to between 1.5 and 3 cm. In the largest diameter option above, the area ratio is 1.3 and is nearly optimal for balancing erosion. In this case the erodible electrode mass is 328 g with Elkonite™ electrodes. The lifetime of this electrode assembly is in excess of 18,000 shots with >20 C per shot.

While the above-described embodiments show the outer-ring or pin ground electrode (122, 132, 142, 152, 162) sandwiched between the welded lip (126, 136, 46, 56, 66) and a spacer ring (27, 37, 47, 57, 67), one skilled in the art will recognize other configurations are possible. For example, the spacer ring (27, 37, 47, 57, 67) could be machined with an interference-fit recess that accepts the outer-ring or pin ground electrode (122, 132, 142, 152, 162). The smaller outer-ring ring or pin electrode (122, 132, 142, 152, 162) could then be hydraulically pressed into the spacer ring (27, 37, 47, 57, 67), and this single-piece assembly could be sandwiched between the insulator system (25, 35, 45, 55, 65) and the welded lip (126, 136, 46, 56, 66).

In the above-described embodiments, the electric field enhancement in ring electrodes is much greater than that of a pin electrode of comparable erodible mass. Accordingly, for equivalent erodible mass per unit length, the ring electrode will break down more reliably and do so at a lower voltage. The available mass per radial unit of length is also much greater than pin electrodes mass per axial length. Thus, ring electrodes will last for more shots with less increase in gap. The large inner area of the electrodes creates a huge increase in the statistical breakdown probability of the electrode resulting in significant reductions in delay and jitter of the electrical breakdown. In water arcs, the breakdown jitter and delay is dependent on the total area of the electrodes. The mass available on the outer ground (negative) electrode is naturally larger than the inner electrode by the ratio of diameters and compensates nicely for the approximately 15% to 25% higher erosion measured on the negative polarity electrode. The pressure pulse in the water that is generated by the ms-duration arc reflects off of the insulator underneath the radial arc and, after reflection, pushes the arc away from the electrodes and, on our ms-time scale, increases the length and, hence, increasing the resistance of the arc during the pulse. Furthermore, the primary arc path is radial between the electrodes (i.e., the nearest location of a grounded conductor in the axial direction is 10's of cm away and never arcs). The radial switch operates reliably over a larger range of radial gap than the axial gap of a pin switch. Finally, the ring electrode configuration operates with low delay and jitter at static pressures up to 150 bars. In contrast, pin or rod electrodes typically become unreliable at water pressures greater than 50 bars.

To compare erosion rates of ring electrodes with various materials, an initial outer diameter (OD) of the inner-ring HV electrode is set to 4.5 cm while the inner diameter (ID) of the outer-ring ground electrode is set to 8.5 cm. A wide range of dimensions are possible, however, an initial radial electrode gap of 2 cm is used for sufficient electrical coupling. Erosion rates of ring electrodes with various materials at these physical dimensions are provided below:

| Material | mm/MC |
|---|---|
| brass | 487 |
| 4340 steel | 260 |
| 316 steel | 231 |
| Hastalloy | 317 |

-continued

| Material | mm/MC |
|---|---|
| tantalum | 200 |
| Mallory 2000 | 103 |
| tungsten | 58 |
| Elkonite 50W-3 | 41 |

Various materials can be used for the electrodes that are known to those skilled in the art. In general, such materials should minimize erosion. Examples of such materials include steels (e.g., stainless and hard carbon steels), refractory metals (e.g., tungsten, tantalum, tungsten alloys), nickel alloys (e.g., Hastelloy) and carbon (e.g., graphite, carbon-carbon composites). The electrode material can vary based on the application (e.g., trade-offs between cost and performance). In embodiments, stainless steel is used because it is a relatively inexpensive electrode material per shot. In embodiments, Elkonite™ 50W-3 is used as the electrode material as it provides an improved lifetime (i.e., minimal erosion). Of course, other Elkonite™ alloys could alternatively be used in other embodiments.

The erosion rate of ring electrodes is much lower than typical axial rod or pin electrodes. The electrode dimensions (height, inner electrode OD, outer electrode ID) can have significant effects on performance for the following reasons:

- The height and the gap spacing of the electrodes determine the average electric field strength seen at the surface of the electrodes. The higher the electric field at the surface of the electrode, the more rapidly an electrical arc will form. In general, smaller height electrodes can be used to obtain a large geometrical electric field enhancement. Electric field enhancement is one of the key advantages of massive radial electrodes compared to a simple pin or rod electrode of comparable erodible mass.
- The electrode OD and ID sets the initial electrode gap and the amount of the electrode that can be eroded before there are no more electrodes left. Since radial electrodes can operate with a larger gap (e.g., >3 cm), approximately 0.5 cm of available radial extent can be on both electrodes.
- The larger the initial OD and ID of the electrodes the more electrode mass is available to erode.
- The larger the electrode gap, the larger the resistance of the arc and the better the electrical energy is coupled to the dielectric fluid medium (e.g., water) arc. This implies that the electrodes will perform better after some erosion has occurred.
- Leakage current in a dielectric fluid medium (e.g., conductive water having salinity greater than 1000-ppm total dissolved solids) is reduced if the total area of the high-voltage electrode is reduced. Thus, the exposed surface area of the high-voltage electrode can be minimized to reduce leakage current. In embodiments, the surface area of the inner-ring HV electrode is sealed with a durable, but flexible epoxy. For example, 3M Scotchcast™ epoxies can be used, which erode away as the electrode erodes.

Overall, the electrode dimensions are in general maximized in the radial direction for a particular application (i.e., the largest outer electrode diameter is used). In embodiments, the OD of the inner electrode is set for an initial gap of about 2 cm. The height of the electrodes is set at about 6 mm as a starting point, but can be increased to a height of up to 10 mm in some embodiments. In embodiments, a radial erosion of at least 0.5 cm can be used for the electrodes (i.e., an increase in the ID of the outer electrode by at least 0.5 cm and a decrease in the OD of the inner electrode by at least 0.5 cm), which allows a total material erosion of 1 cm during operation of the electrode prior to refurbishment.

A ring electrode design lends itself to robust mechanical construction (e.g., ring electrode having no measurable damage after many hundreds of shots at energy levels above 100 kJ). In embodiments, the outer-ring ground electrode is radially contained by the steel housing of the shock generating assembly. The force generated by the discharge is directly radially outward on the outer-ring ground electrode. The small height of the outer-ring ground electrode minimizes torque on the electrode that might be induced by an arc above the center-line of the ring electrodes. The inner-ring HV electrode is fixed to a relatively large diameter shaft that is supported by the insulator. The inner-ring HV electrode is also mounted close to the insulator, again minimizing the cantilever torque on the electrode shaft, maximizing the shaft length supported by the insulator, and minimizing the potential damage to the electrode or the insulator.

In embodiments, approximately 20 shots are applied to condition the electrodes. During this conditioning sequence there can be a significant jitter in the delay time for arc formation. The conditioning acts to roughen the surface of the electrode and erode off any sharp edges that were in the original electrodes. Once the electrodes are conditioned, the operational characteristics are extremely stable. For example, the electrodes can then be used for thousands of shots with no maintenance. In general, erosion of an electrode first smoothes any sharp edges that may be on a freshly machined electrode and roughens up the surfaces of the opposing electrodes. After several dozen shots on a ring electrode configuration, the inner surface of the outer-ring ground electrode and the outer surface of the inner-ring HV electrode are typically very rough. These rough surfaces act as initiation points for streamer formation and the resultant future water arcs. Overtime, the ring electrode configuration may alter the erosion pattern (i.e., the arcs can move from the surfaces closest to one another to the top surface of the ring electrodes away from the insulator). While not wishing to be bound by a particular theory, it is believed that such an arc motion occurs for current pulses whose length is greater than approximately 1 ms and appears to be caused by the pressure build up under the arc between the arc and the insulator. The motion of the arc on the electrodes serves to reduce the erosion on the surface of the electrode by reducing the peak temperature attained by the electrode material.

In embodiments, the life of an electrode assembly is extended by stacking ring electrodes. This is a pancake arrangement increases electrode mass by allowing multiple electrodes in parallel. However, this multiple electrode approach might be limited at some point as the arcs and the pressure pulses generated by them might become "buried" inside the electrode stack. In embodiments, stack height consists of two to five sets of electrodes.

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

While in the foregoing specification this invention has been described in relation to certain preferred embodiments thereof, and many details have been set forth for the purpose of illustration, it will be apparent to those skilled in the art that the invention is susceptible to alteration and that certain other details described herein can vary considerably without departing from the basic principles of the invention. For example, the above-described system and method can be combined with other fracturing techniques.

What is claimed is:

1. A method for generating high-pressure pulses in a dielectric medium to generate fractures in a subterranean reservoir, the method comprising:

providing a wellbore in fluid communication with a producing zone of a hydrocarbon bearing formation;

positioning an electrode assembly within the wellbore in a dielectric medium, the electrode assembly having an assembly housing, the electrode assembly further having a first electrode positioned within and supported by the assembly housing and having a second electrode positioned within the assembly housing, the second electrode being disposed radially outward from the first electrode such that a gap is defined therebetween; and delivering an electric current pulse to the electrode assembly using a pulser, the electric current pulse having a length of time greater than 100 microseconds and maintaining a substantially constant current during the length of time of the electric current pulse, such that an electric arc is formed between the first electrode and second electrode, thereby producing a sufficient pressure pulse in the dielectric medium to induce or extend fractures in the hydrocarbon bearing formation, wherein delivering the electric current pulse to the electrode assembly comprises delivering at least 1 kilojoule of energy to the electrode assembly during the length of time of the electric current pulse, and wherein the pulser further comprises a pulse-forming network including a plurality of capacitors arranged in parallel and a plurality of inductors arranged in series.

2. The method of claim 1, wherein delivering the electric current pulse to the electrode assembly comprises delivering between 1 and 500 kilojoules of energy to the electrode assembly during the length of time of the electric current pulse.

3. The method of claim 1, further comprising repeating delivery of the electric current pulse to the electrode assembly at a frequency of less than 10 hertz.

4. The method of claim 1, further comprising repeating delivery of the electric current pulse to the electrode assembly at a frequency of less than 2 hertz.

5. The method of claim 1, wherein delivering the electric current pulse to the electrode assembly comprises delivering a voltage between 5 and 40 kilovolts to the electrode assembly.

6. The method of claim 1, wherein delivering the electric current pulse to the electrode assembly comprises delivering a voltage between 10 and 20 kilovolts to the electrode assembly.

7. The method of claim 1, wherein the length of time of the electric current pulse is between 200 microseconds and 20 milliseconds.

8. The method of claim 1, wherein the length of time of the electric current pulse is between 1 millisecond and 20 milliseconds.

9. The method of claim 1, wherein delivering the electric current pulse to the electrode assembly comprises delivering a current of at least 5 kilo amps during the length of time of the electric current pulse.

10. The method of claim 1, further comprising modifying the length of time of the electric current pulse to further induce or extend fractures in the hydrocarbon bearing formation.

11. The method of claim 1, further comprising repeating the delivery of the electric current pulse to the electrode assembly at a modified length of time, a modified energy level, or a combination thereof.

12. The method of claim 1, wherein the dielectric medium comprises at least one of water, saline water, oil, or drilling mud.

13. The method of claim 1, wherein the pulser delivers the electric current pulse to the electrode assembly, and wherein the pulser is located in remote proximity to the electrode assembly and the pulser is external to the wellbore.

14. The method of claim 1, wherein the pulse-forming network is configured to achieve shaped electrical pulse characteristics that generate pressure pulses within the wellbore to induce or extend fractures in the hydrocarbon bearing formation.

15. A system for generating high-pressure pulses in a dielectric medium to generate fractures in a subterranean reservoir, the system comprising:

an electrode assembly configured to be disposed within a wellbore in a dielectric medium, the electrode assembly having an assembly housing, the electrode assembly further having a first electrode positioned within and supported by the assembly housing at a proximate end and having a second electrode positioned within the assembly housing, the second electrode being disposed radially outward from the first electrode such that a gap is defined therebetween, wherein the wellbore is in fluid communication with a producing zone of a hydrocarbon bearing formation; and a pulser configured to deliver an electric current pulse to the electrode assembly, the electric current pulse having a length of time greater than 100 microseconds and maintaining a substantially constant current during the length of time of the electric current pulse, to form an electric arc between the first electrode and the second electrode, thereby producing a pressure pulse in the dielectric medium to induce or extend fractures in the hydrocarbon bearing formation, wherein the pulser delivers the electric current pulse to the electrode assembly at an energy level of at least 1 kilojoule, and wherein the pulser further comprises a pulse-forming network including a plurality of capacitors arranged in parallel and a plurality of inductors arranged in series.

16. The system of claim 15, wherein the pulser delivers the electric current pulse to the electrode assembly at an energy level of between 1 and 500 kilojoules.

17. The system of claim 15, wherein the pulser delivers the electric current pulse to the electrode assembly at a voltage between 5 and 40 kilovolts.

18. The system of claim 15, wherein the pulser delivers the electric current pulse to the electrode assembly at a voltage between 10 and 20 kilovolts.

19. The system of claim 15, wherein the length of time of the electric current pulse is between 200 microseconds and 20 milliseconds.

20. The system of claim 15, wherein the length of time of the electric current pulse is between 1 millisecond and 20 milliseconds.

21. The system of claim 15, wherein the pulser delivers the electric current pulse to the electrode assembly at a current of at least 5 kilo amps during the length of time of the electric current pulse.

22. The system of claim 15, wherein the pulser delivers at least 50 kilojoules of energy to the electrode assembly during the length of time of the electric current pulse.

23. The system of claim 15, wherein the pulser delivers a plurality of electrical current pulses to the electrode assembly at a frequency of less than 10 hertz.

24. The system of claim 15, wherein the pulser comprises one of a solid-state electrical switch, a gas-based electrical switch, or an inductive pulse-forming network and an opening switch.

25. The system of claim 15, wherein the plurality of capacitors comprise a first set of capacitors having a predetermined value and a second set of capacitors having a predetermined value being different from the first set of capacitors.

26. The system of claim 15, wherein the plurality of inductors comprise a first set of inductors having a predetermined value and a second set of inductors having a predetermined value being different from the first set of inductors.

27. The system of claim 15, wherein the first electrode is disposed radially within a ring defined by the second electrode.

28. The system of claim 15, wherein the radial gap between the first electrode and the second electrode is between 0.5 and 4 centimeters.

29. The system of claim 15, wherein the pulser that delivers the electric current pulse to the electrode assembly is located in remote proximity to the electrode assembly and is external to the wellbore.

30. The system of claim 15, wherein the pulse-forming network is configured to achieve shaped electrical pulse characteristics that generate pressure pulses within the wellbore to induce or extend fractures in the hydrocarbon bearing formation.

31. An electrode assembly for generating high-pressure pulses in a dielectric medium, the electrode assembly comprising:

an assembly housing having a proximate end and a distal end;

a first electrode positioned within and supported by the assembly housing at the proximate end;

a second electrode positioned within the assembly housing at the proximate end radially inward from the first electrode such that a radial gap is defined therebetween; and an insulator positioned within the assembly at the distal end to electrically insulate the first electrode and the second electrode;

wherein the electrode assembly is configured to be disposed in a dielectric medium, receive an electric current pulse from a pulser having a length of time greater than 100 microseconds and maintaining a substantially constant current during the length of time of the electric current pulse, and form an electric arc between the first electrode and the second electrode, thereby producing a pressure pulse axially away from the insulator, wherein the pulser further comprises a pulse-forming network including a plurality of capacitors arranged in parallel and a plurality of inductors arranged in series.

32. The electrode assembly of claim 31, wherein the first electrode is a ground electrode.

33. The electrode assembly of claim 31, wherein the first electrode comprises an array of radial pins.

34. The electrode assembly of claim 31, wherein the first electrode comprises a ring electrode.

35. The electrode assembly of claim 31, wherein at least one of the first electrode or the second electrode is composed of an Elkonite alloy, tungsten, or carbon composite.

36. The electrode assembly of claim 31, wherein the second electrode is coupled to the insulator.

37. The electrode assembly of claim 31, wherein the first electrode has an inner diameter of 8.5 centimeters.

38. The electrode assembly of claim 31, wherein the first electrode has an inner diameter of up to 12 centimeters.

39. The electrode assembly of claim 31, wherein the second electrode has an outer diameter of 4.5 centimeters.

40. The electrode assembly of claim 31, wherein the second electrode has an outer diameter up to 12 centimeters.

41. The electrode assembly of claim 31, wherein at least one of the first electrode or the second electrode have an axial length of at least 10 millimeters.

42. The electrode assembly of claim 31, wherein the radial gap between the first electrode and the second electrode is between 0.5 and 4 centimeters.

43. The electrode assembly of claim 31, further comprising a stack of first electrodes positioned within and coupled to the assembly housing at the proximate end; and a stack of second electrodes positioned within the assembly housing at the proximate end radially inward from the stack of first electrodes such that radial gaps are defined therebetween.

44. The electrode assembly of claim 31, wherein the pulser that delivers the electric current pulse to the electrode assembly is located in remote proximity to the electrode assembly and is external to the wellbore.

45. The electrode assembly of claim 31, wherein the pulse-forming network is configured to achieve shaped electrical pulse characteristics that generate pressure pulses within the wellbore to induce or extend fractures in the hydrocarbon bearing formation.

* * * * *